US007116934B2

(12) United States Patent
Mizoguchi et al.

(10) Patent No.: US 7,116,934 B2
(45) Date of Patent: Oct. 3, 2006

(54) IMAGE FORMING APPARATUS WITH PHOTOSENSITIVE MEMBER CLEANING BLADE

(75) Inventors: Yoshihiro Mizoguchi, Fukuoka (JP); Yoshiaki Ijima, Dazaifu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 72 days.

(21) Appl. No.: 10/659,220

(22) Filed: Sep. 10, 2003

(65) Prior Publication Data

US 2004/0052558 A1 Mar. 18, 2004

(30) Foreign Application Priority Data

Sep. 12, 2002 (JP) ..... P. 2002-266722
Jun. 26, 2003 (JP) ..... P. 2003-182324

(51) Int. Cl.
*G03G 21/00* (2006.01)

(52) U.S. Cl. ..... 399/351; 399/350

(58) Field of Classification Search ..... 399/123, 399/343, 349, 350, 351
See application file for complete search history.

(56) References Cited

U.S. PATENT DOCUMENTS 4,152,067 A * 5/1979 Kubota ..... 399/351
4,576,468 A * 3/1986 Saito ..... 399/351
4,639,123 A * 1/1987 Adachi et al. ..... 399/351
4,730,205 A * 3/1988 Ogiri et al. ..... 399/350 X
4,999,678 A * 3/1991 Tange ..... 399/349
5,031,000 A * 7/1991 Pozniakas et al. ..... 399/349
5,066,983 A * 11/1991 Tonomoto ..... 399/349
5,218,412 A * 6/1993 Martin ..... 399/351
5,241,350 A * 8/1993 Bigelow ..... 399/351
5,321,483 A * 6/1994 Yokoyama et al. ..... 399/351
5,608,509 A 3/1997 Shirai et al.
6,553,195 B1 * 4/2003 Korfhage et al. ..... 399/343 X
2002/0114644 A1 8/2002 Stickler

FOREIGN PATENT DOCUMENTS

EP 0 570 249 11/1993
JP 2002-6705 1/2002

* cited by examiner

*Primary Examiner*—Sandra L. Brase
(74) *Attorney, Agent, or Firm*—Pearne & Gordon LLP

(57) ABSTRACT

In an image forming apparatus, the workability of assembling of a cleaning blade is improved, and the dimensional accuracy between the cleaning blade and a photosensitive member is properly ensured. A cleaning blade 19 having a body portion 19*a* configured by an elastic plate member and a planar base plate portion 19*b* to which the body portion 19*a* is secured is held and secured by: a first butting part P1 which is a predetermined position in a first face S1 positioned in a front portion of the base plate portion 19*b* in the rotation direction of a photosensitive drum 2*a* to 5*a*; a second butting part P2 which is in a second face S2 opposed to the first face S1, and which is positioned closer to the photosensitive drum 2*a* to 5*a* than the first butting part P1; a third butting part P3 which is an end part of the base plate portion 19*b* that is opposite to the photosensitive drum 2*a* to 5*a*; and the photosensitive drum.

24 Claims, 10 Drawing Sheets

IMAGE FORMING APPARATUS WITH PHOTOSENSITIVE MEMBER CLEANING BLADE

BACKGROUND OF THE INVENTION

The present invention relates to an image forming apparatus.

In an image forming apparatus which uses the electrophotographic system, conventionally, a photosensitive member which is an image carrier is charged by a charging device, the charged photosensitive member is irradiated with light corresponding to image information to form a latent image, the latent image is developed by a developing device, and the developed toner image is transferred to a recording medium to form an image.

In accordance with advancement of the image colorization, a tandem color image forming apparatus having plural image forming units for respectively performing image forming processes has been proposed. In such apparatus, color toner images including a cyan image, a magenta image, a yellow image, and preferably a black image are formed on respective photosensitive members, and the toner images are overlaid and transferred to an endless intermediate transfer member in transferring positions of the photosensitive members, thereby forming a full-color image.

Such a tandem color image forming apparatus has the image forming units for respective colors, and hence is advantageous in enhancing the speed.

Hereinafter, a conventional tandem color image forming apparatus will be described.

FIG. 11 is a diagram showing the configuration of a conventional color image forming apparatus.

Referring to FIG. 11, in a main unit 1 of the color image forming apparatus, image forming units 2, 3, 4, and 5 for respectively forming toner images of yellow (Y), magenta (M), cyan (C), and black (K) are placed. Exposing devices 6*a*, 6*b*, 6*c*, and 6*d* are disposed so as to respectively correspond to the image forming units 2 to 5. The image forming units 2 to 5 comprise: photosensitive drums (photosensitive members) 2*a*, 3*a*, 4*a*, and 5*a* which are irradiated with laser beams emitted from the exposing devices 6*a* to 6*d* to form electrostatic latent images on their peripheral faces; developing rollers (developing sections) 2*b*, 3*b*, 4*b*, and 5*b* which cause toners supplied from respective toner tanks to adhere to the photosensitive drums 2*a* to 5*a*, thereby developing the electrostatic latent images as toner images; and cleaning blades which remove away toners that remain on the photosensitive drums 2*a* to 5*a* after the image transfer.

An endless intermediate transfer belt (intermediate transfer member) 7 to which the developed color toner images on the photosensitive drums 2*a*, 3*a*, 4*a*, and 5*a* are to be overlaid and transferred to form a color toner image is placed below the image forming units 2 to 5 so as to be runnable in the direction of the arrow. In a loop of the intermediate transfer belt 7, a driving roller 8, a tension roller 9, four first transfer rollers 10*a*, 10*b*, 10*c* and 10*d*, and a driven roller 11 are arranged.

A sheet supply cassette 13 in which sheets (recording media) P are housed is disposed in a lower portion of the apparatus. The sheets P are fed one by one from the sheet supply cassette 13 to a sheet transport path by a sheet feed roller.

A second transfer roller 12 which is in contact with a given distance of the outer peripheral face of the intermediate transfer belt 7 in the position of the driven roller 11, thereby transferring the color images on the intermediate transfer belt 7 to the sheet P, and a fixing device 14 which fixes the color images transferred onto the sheet P, to the sheet P are placed on the sheet transport path.

The photosensitive drums 2*a* to 5*a* of the image forming units 2 to 5 cause the yellow, magenta, cyan, and black toner images to attach to the surface of the intermediate transfer belt 7, thereby forming color images. The toner color images are transferred to the sheet P fed from the sheet supply cassette 13, by a nip force exerted between the driven roller 11 and the second transfer roller 12. The sheet P is then fed to the fixing device 14, and the toner image is fixed thereto. Thereafter, the sheet is discharged.

In the color image forming apparatus, each of the above-mentioned cleaning blades is formed by a body portion configured by an elastic plate member, and a planar base plate portion to which the body portion is secured. The base plate portion is directly secured to a case of the apparatus by screws (for example, see Japanese Patent Publication JP-A-2002-006705).

In the configuration of the conventional art, the cleaning blades must be secured by using screws. Therefore, the workability of the assembly process is impaired.

The cleaning blades are secured by passing the screws through holes formed in the cleaning blades. Consequently, it is difficult to ensure the dimensional accuracy between the cleaning blades and the respective photosensitive drums.

SUMMARY OF THE INVENTION

It is an object of the invention to provide an image forming apparatus in which the workability of assembling of a cleaning blade is excellent.

It is another object of the invention to provide an image forming apparatus in which the dimensional accuracy between a cleaning blade and a photosensitive member can be properly ensured.

In order to solve the problems, the image forming apparatus of the invention comprises: a photosensitive member which is rotatably disposed, and on which an electrostatic latent image is developed to form a toner image; a cleaning blade which includes a body portion configured by an elastic plate member, and a base plate portion supporting the body portion, and which removes away a toner that remains on the photosensitive member after the toner image is transferred, by means of the body portion that pressingly contacts the photosensitive member; a housing which holds the photosensitive member and the cleaning blade; and a recess which is disposed in the housing, and which accommodates at least part of the base plate, and the cleaning blade being pressingly secured to the recess by the photosensitive member.

According to the configuration, since the cleaning blade is pressingly secured to the recess of the housing by the photosensitive member, the cleaning blade is not required to be screw-secured to the housing. Therefore, the workability of the assembly process is improved.

DETAILED DESCRIPTION OF THE PREFERRED EMBODIMENTS

Figure 1:
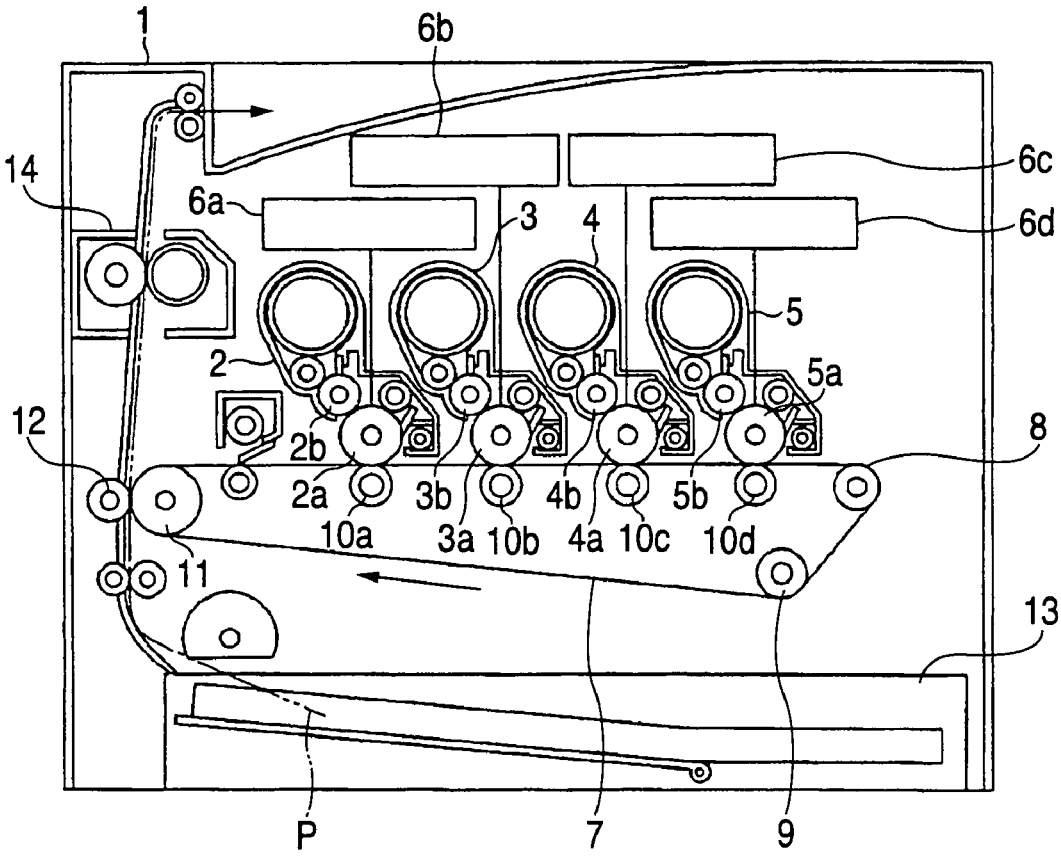
FIG. 1 is a diagram showing the configuration of a color image forming apparatus which is a first embodiment of the invention.

Hereinafter, an embodiment of the invention will be described with reference to FIGS. 1 to 10. In the figures, identical components are denoted by the same reference numerals, and duplicated description will be omitted.

Referring to FIG. 1, in the main unit 1 of the color image forming apparatus, the image forming units 2, 3, 4, and 5 for respectively forming toner images of yellow (Y), magenta (M), cyan (C), and black (K) are detachably placed in sequence. The exposing devices 6*a*, 6*b*, 6*c*, and 6*d* are disposed so as to respectively correspond to the image forming units 2 to 5.

Figure 2:
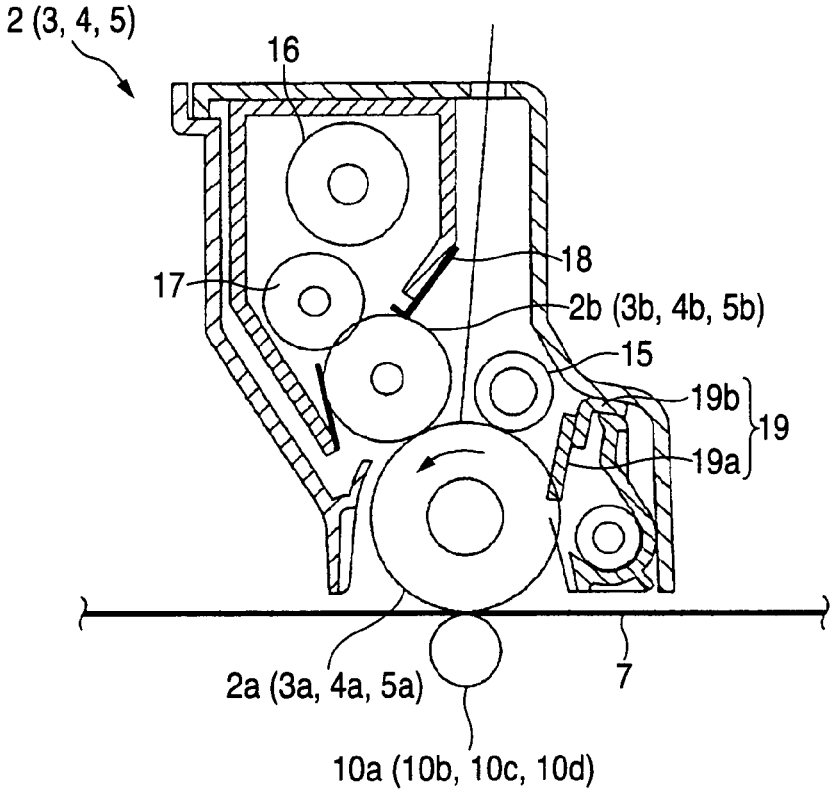
FIG. 2 is a diagram showing in detail an image forming unit in the color image forming apparatus of FIG. 1.

As shown in FIG. 2 in detail, each of the image forming units 2 to 5 comprises: the photosensitive drum (photosensitive member) 2*a*, 3*a*, 4*a*, or 5*a* which serves as a rotatable image carrier; a charging device (charging section) 15 which charges the photosensitive drum 2*a* to 5*a* to a uniform potential; the developing roller (developing section) 2*b*, 3*b*, 4*b*, or 5*b* for causing a toner supplied from a toner tank to adhere to the photosensitive drum 2*a* to 5*a* in which an electrostatic latent image is formed on the peripheral face by irradiation of a laser beam emitted from an exposing device 6*a* to 6*d*, thereby developing the electrostatic latent image as a toner image; an agitator 16 which agitates the toner in the toner tank; a supply roller 17 which supplies the toner to the developing roller 2*b* to 5*b*; a doctor blade 18 which adjusts the thickness of the toner supplied to the developing roller 2*b* to 5*b* to a predetermined value, and which charges the toner by friction; and a cleaning blade 19 which removes away a toner that remains on the photosensitive drum 2*a* to 5*a* after transferring the image to the intermediate transfer belt 7. The photosensitive drums 2*a*, 3*a*, 4*a*, and 5*a* which are circumferentially rotated are arranged in a row so that their rotation axes are parallel to one other.

Figure 3:
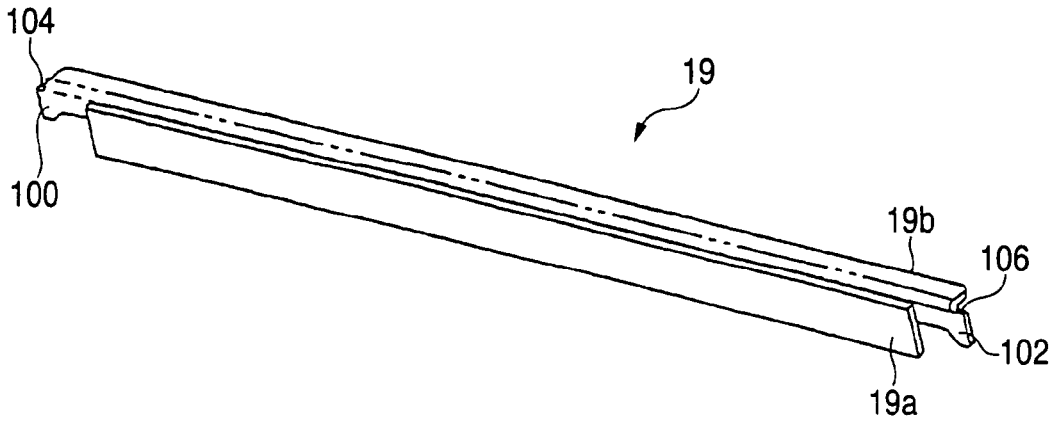
FIG. 3 is a perspective view showing a cleaning blade which is to be attached to the image forming unit of FIG. 2.

As shown in FIG. 3, the cleaning blade 19 includes a body portion 19*a* configured by an elastic plate member made of urethane rubber or the like, and a planar base plate portion 19*b* to which the body portion 19*a* is secured, and which is a sheet metal having an L-like section shape. A residual toner is removed away by the body portion 19*a* which pressingly contacts the photosensitive drum 2*a* to 5*a*.

Left and right butting parts 104 and 106 are formed in left and right end portions 100 and 102 of the base plate portion 19*b*, respectively. In the left and right butting parts 104 and 106, the base plate portion 19*b* does not have an L-like section shape.

Figure 4:
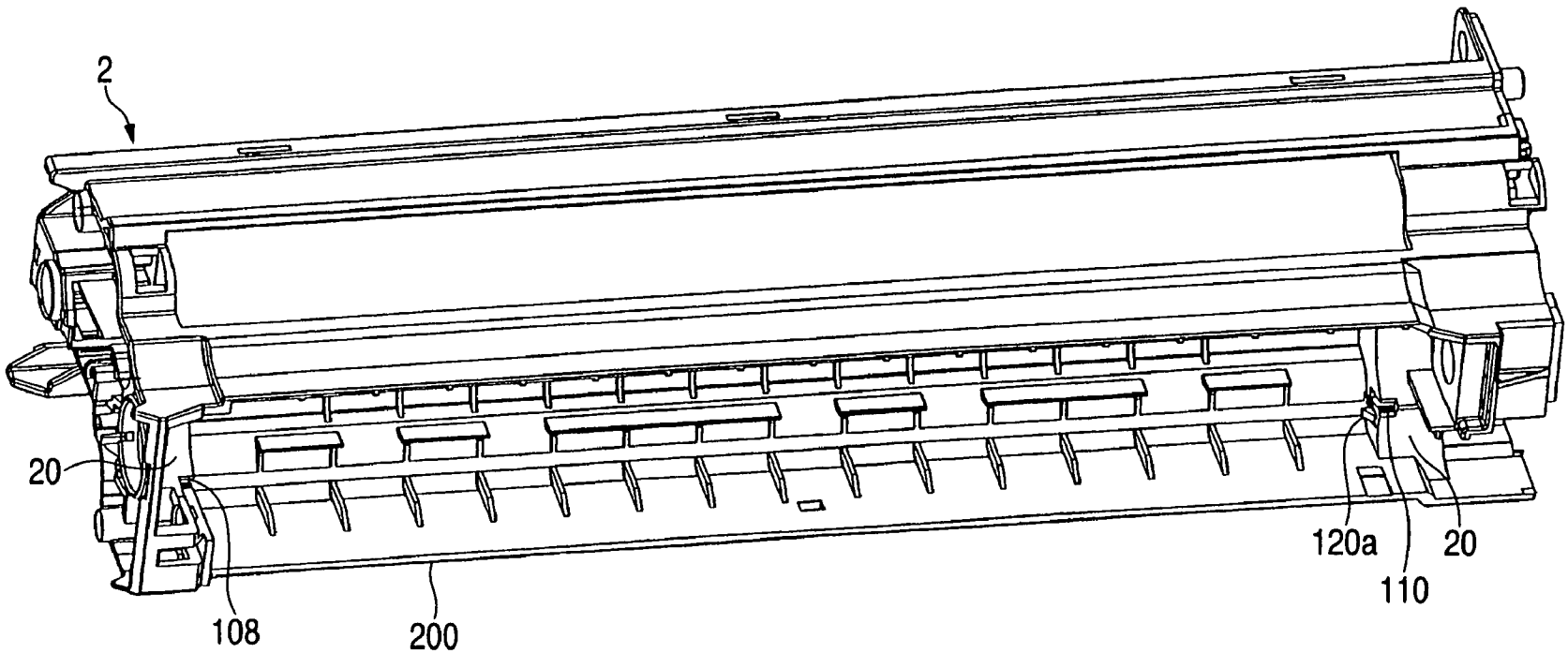
FIG. 4 is a perspective view of the image forming unit of the first embodiment of the invention in which the cleaning blade has not yet been attached to a holding portion, as viewed from the left front side.
Figure 5:
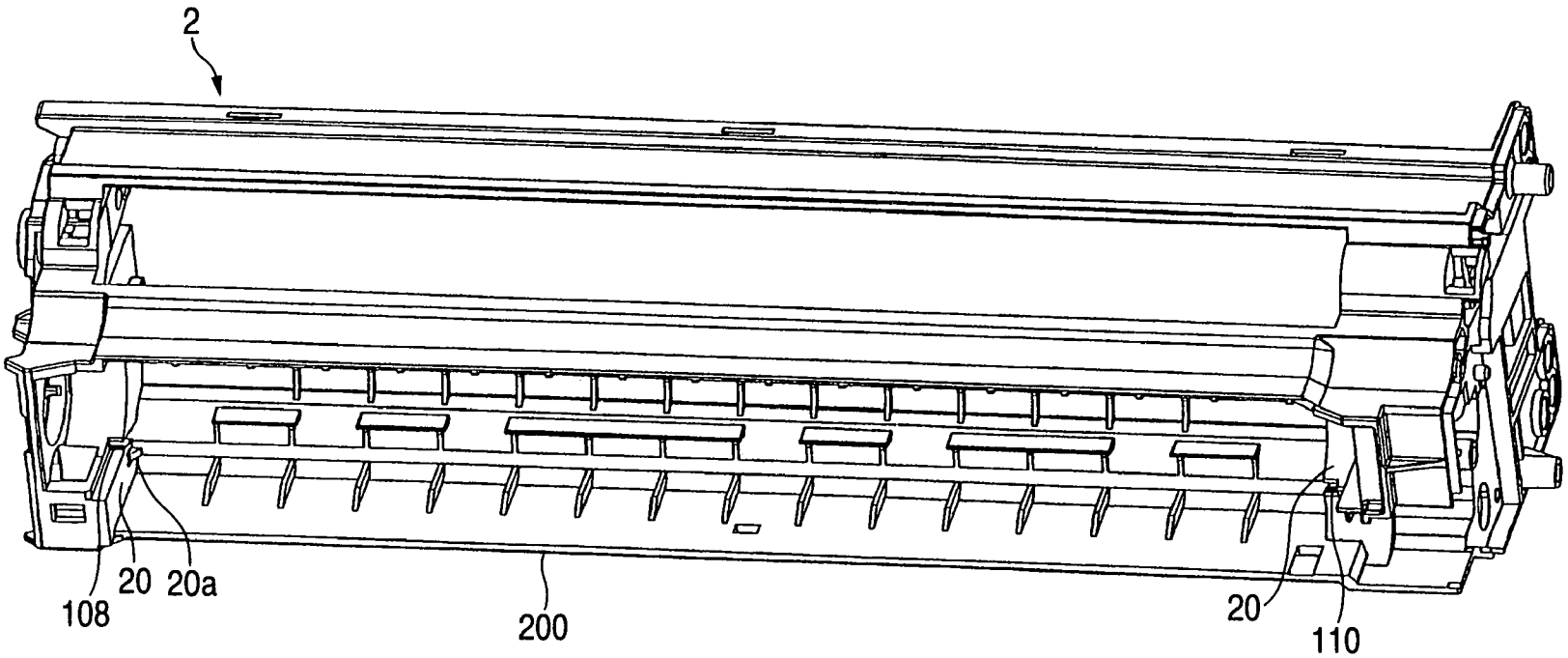
FIG. 5 is a perspective view of the image forming unit of the first embodiment of the invention in which the cleaning blade has not yet been attached to the holding portion, as viewed from the right front side.

As shown in FIGS. 4 and 5, holding portions 20 are molded integrally with a resin-made housing 200 of the image forming unit 2. Left and right recesses 108 and 110 for holding the cleaning blade 19 are formed in the holding portions 20, respectively. Immediately below the vicinities of the left and right recesses 108 and 110 in the holding portions 20, left and right hooks 20*a* and 120*a* are molded integrally with the housing 200 in order to provisionally attach the cleaning blade 19 to the housing 200. A taper 124 is formed in each of the left and right hooks 20*a* and 120*a*.

Figure 6:
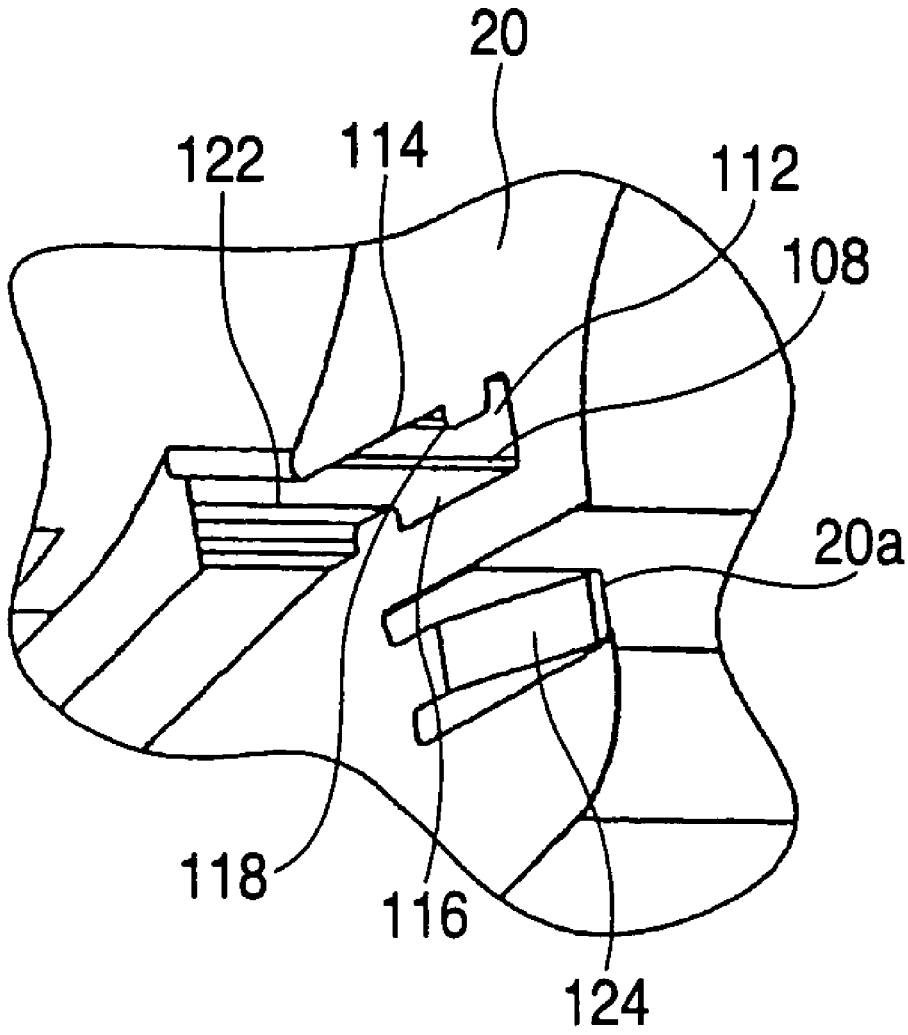
FIG. 6 is a partial enlarged perspective view showing the vicinity of a left recess in FIG. 5.
Figure 10:
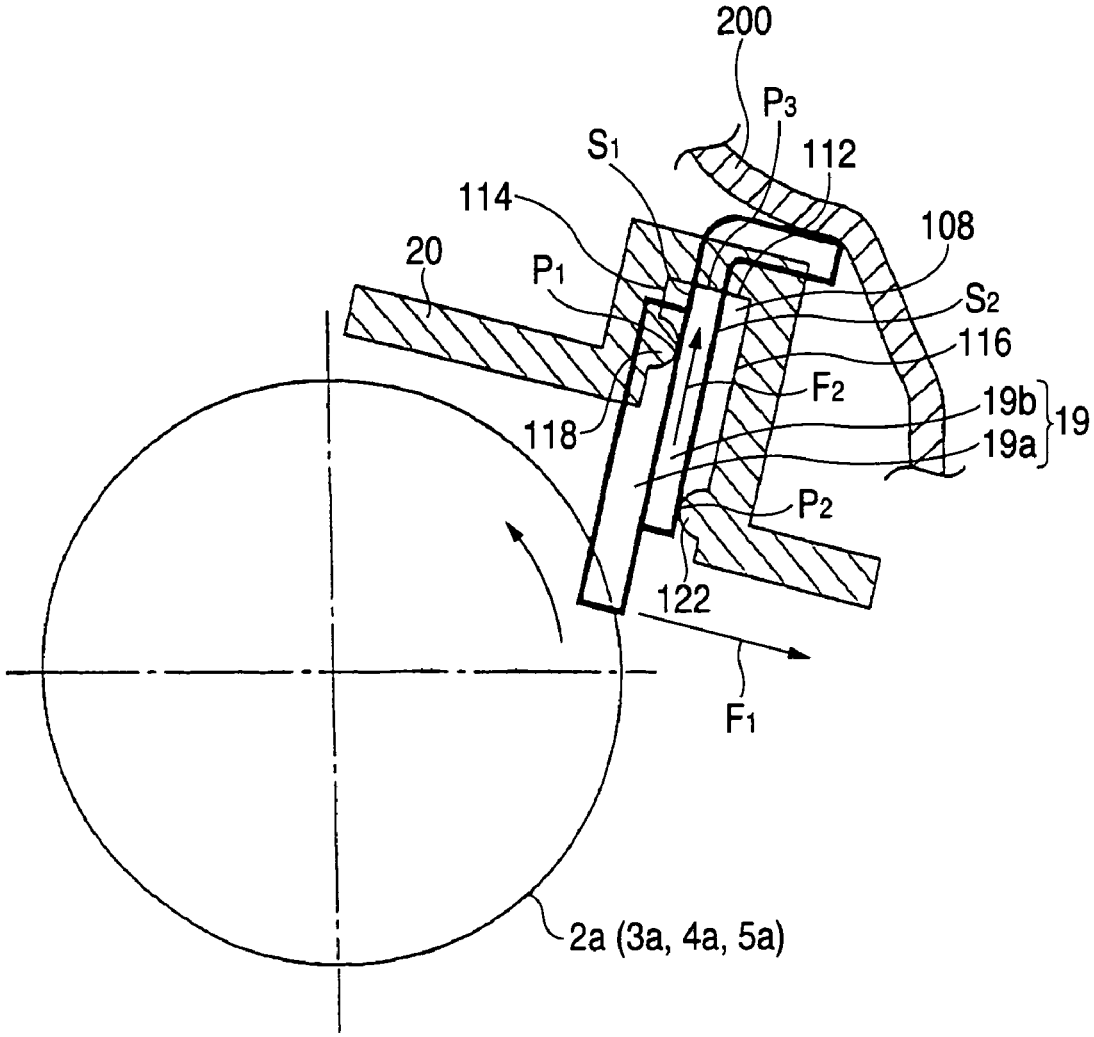
FIG. 10 is a diagram illustrating a state where the cleaning blade in the first embodiment of the invention is secured.
Figure 11:
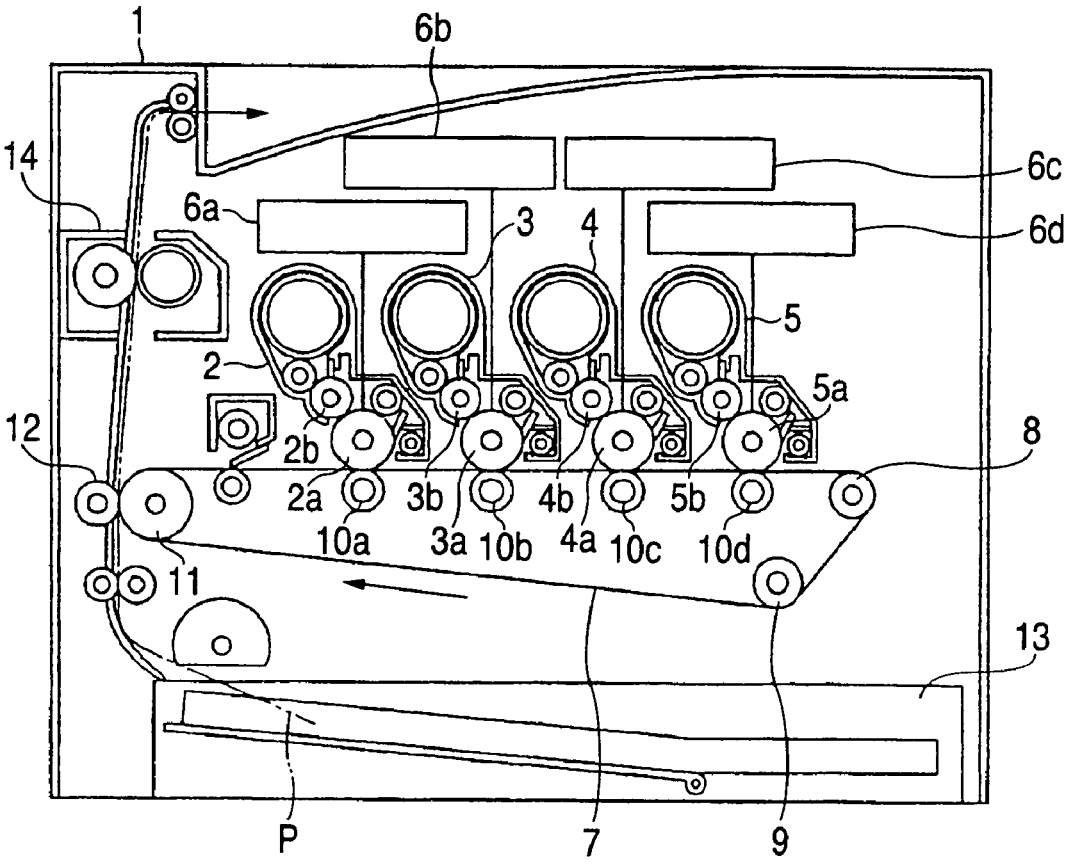
FIG. 11 PRIOR ART
FIG. 11 is a diagram showing the configuration of a conventional color image forming apparatus.

As shown in FIGS. 6 and 10, the left recess 108 is formed by: a front wall 114 which is positioned in the front side in the rotation direction of the photosensitive drum 2*a*; a rear wall 116 which is positioned in the rear side in the rotation direction of the photosensitive drum 2*a*; and a bottom 112 which is positioned between the front and rear walls 114 and 116. A rod-like front projection 118 is formed on the front wall 114 in parallel with the bottom 112. A rod-like rear projection 122 is formed on the rear wall 116 in parallel with the bottom 112 in a position which is more separated from the bottom 112 than the front projection 118. The distance between the front and rear walls 114 and 116 is set to be larger than the thickness of the left and right end portions 100 and 102. The right recess 110 is configured in a similar manner as the left recess 108.

Figure 7:
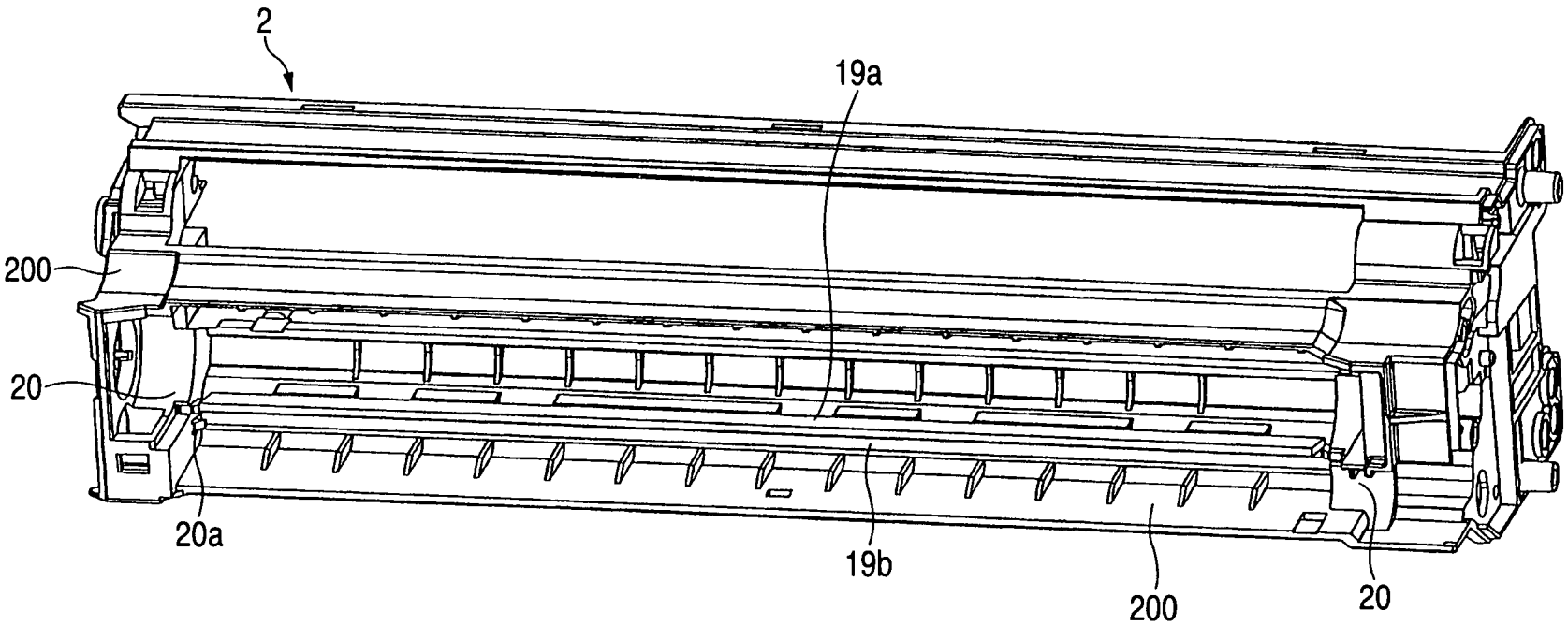
FIG. 7 is a perspective view showing a state where the cleaning blade is attached to the image forming unit shown in FIG. 5.
Figure 8:
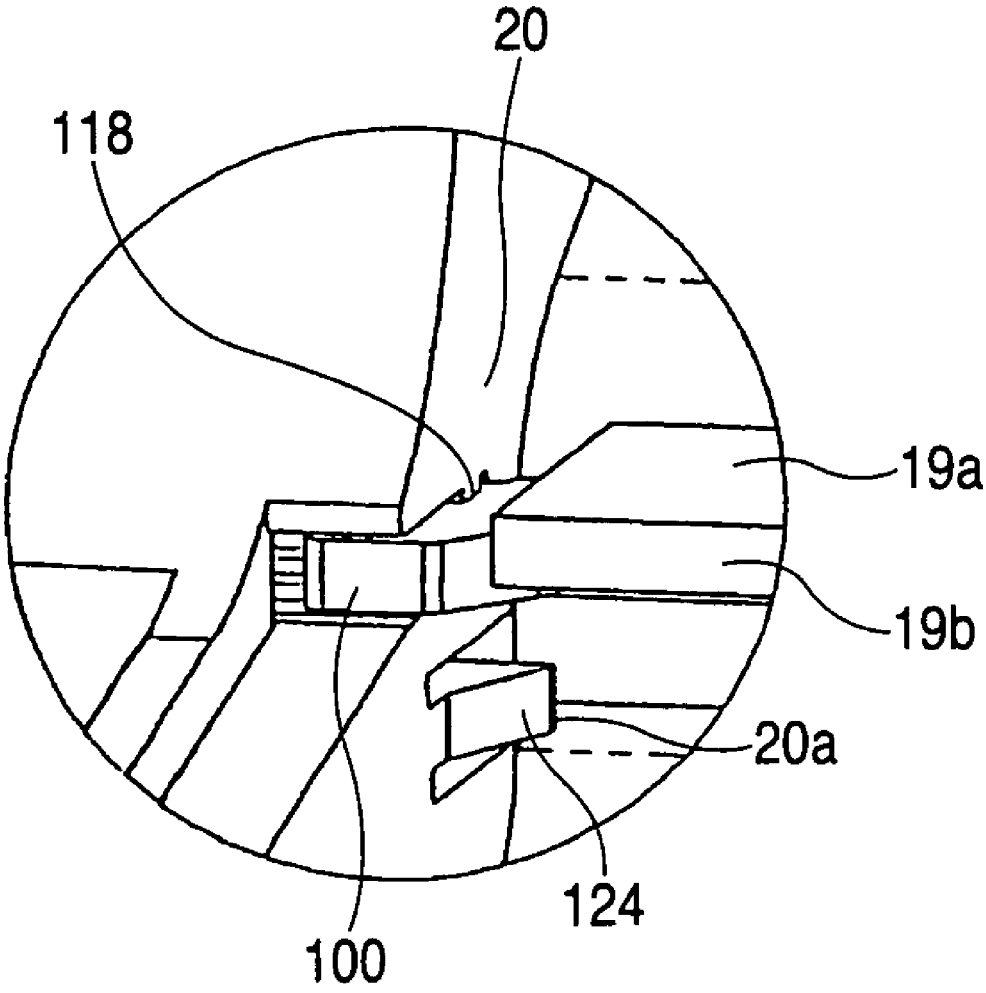
FIG. 8 is a partial enlarged perspective view showing the vicinity of the left recess in FIG. 7.
Figure 9:
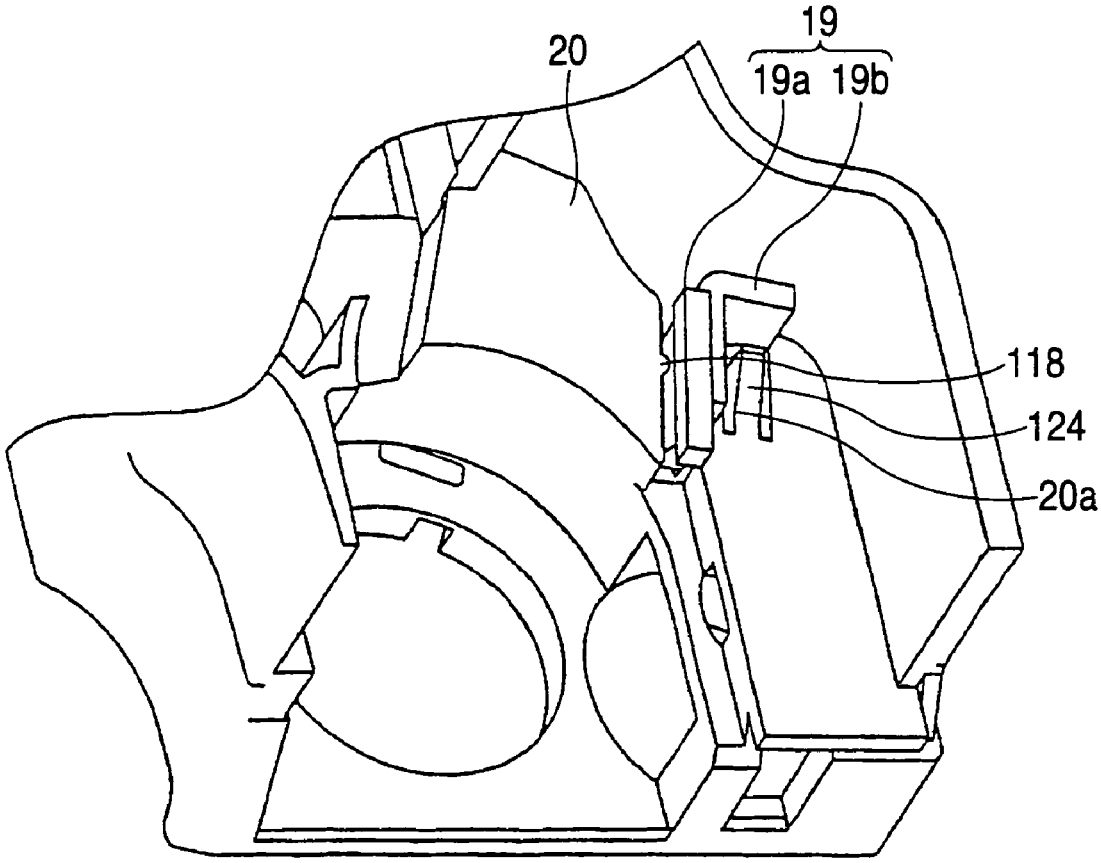
FIG. 9 is a partial cutaway view showing the state where the cleaning blade is attached to the image forming unit shown in FIG. 5.

In the production and assembling of the housing, the cleaning blade 19 is attached in the following manner. The base plate portion 19*b* of the cleaning blade 19 is inserted into the left and right recesses 108 and 110 which are formed in the holding portions 20 shown in FIG. 5. At this time, the insertion is conducted so that the left and right butting parts 104 and 106 butt against the bottom 112 of the left recess 108 and the bottom (not shown) of the right recess 110, respectively. In the insertion, the plate parts which are perpendicular to the body portion 19*a* in both the end portions of the base plate portion 19*b* are inserted so as to override the left and right hooks 20*a* and 120*a*, respectively. Therefore, the cleaning blade 19 is provisionally secured to the housing 200 with forming a play of a certain degree, by the left and right hooks 20*a* and 120*a* (FIGS. 7 and 8).

As shown in FIG. 10, thereafter, the photosensitive drum 2*a* is attached to the housing 200 while the body portion 19*a* of the cleaning blade 19 is pressed in the directions of F1 and F2, whereby the cleaning blade 19 is firmly secured to the housing 200.

As a result, each of the holding portions 20 butts against the base plate portion 19*b* in: a first butting part P1 which is a predetermined position in a first face S1 positioned in a front portion of the base plate portion 19*b* in the rotation direction of the photosensitive drum 2*a* to 5*a*; a second butting part P2 which is in a second face S2 opposed to the first face S1, and which is positioned closer to the photosensitive drum 2*a* to 5*a* than the first butting part P1; and a third butting part P3 (a place corresponding to the left and right butting part 104 or 106) which is an end part of the base plate portion 19*b* that is opposite to the photosensitive drum 2*a* to 5*a*.

In the illustrated example, the first and second butting parts P1 and P2 are formed by projections which are formed on the holding portion 20. Alternatively, such projections may be formed on the base plate portion 19*b*. The image forming units 3, 4, and 5 are configured in the same manner as the image forming unit 2 described above.

Referring to FIG. 1, the endless intermediate transfer belt (intermediate transfer member) 7 to which the developed color toner images on the photosensitive drums 2*a*, 3*a*, 4*a*, and 5*a* are to be overlaid and transferred to form a color toner image is placed below the arranged image forming units 2 to 5 so as to be runnable in the direction of the arrow. In a loop of the intermediate transfer belt 7, arranged are the driving roller 8 which drives the intermediate transfer belt 7 to run, the tension roller 9 which applies given tension to the intermediate transfer belt 7, four first transfer rollers 10*a*, 10*b*, 10*c*, and 10*d* which are arranged correspondingly with the photosensitive drums 2*a* to 5*a*, and which cause the intermediate transfer belt 7 to pressingly contact the photosensitive drums 2*a* to 5*a* to transfer the color toner images on the photosensitive drums 2*a* to 5*a* to the intermediate transfer belt 7, and the driven roller 11 which is rotated as a result of the rotation of the intermediate transfer belt 7 by the driving roller 8. The intermediate transfer belt is circulatingly driven so as to run around these rollers in the direction of the arrow.

During a printing period, the tension roller 9 is urged by a spring (not shown) to be moved toward the right lower side in the figure, thereby applying tension to the intermediate transfer belt 7. During a non-printing period, the tension application to the intermediate transfer belt 7 by the tension roller 9 is cancelled, so that the intermediate transfer belt 7 is not wound around the rollers in the same positions for a long time, thereby suppressing the curling tendency.

The sheet supply cassette 13 in which sheets (recording media) P are housed is disposed in a lower portion of the apparatus. The sheets P are fed one by one from the sheet supply cassette 13 to a sheet transport path by a sheet feed roller.

The second transfer roller 12 which is in contact with a given distance of the outer peripheral face of the intermediate transfer belt 7 in the position of the driven roller 11, thereby transferring the color image on the intermediate transfer belt 7 to the sheet P, and the fixing device 14 in which the color image transferred onto the sheet P is fixed to the sheet P by the pressure and heat due to the clamp rotation of the roller are placed on the sheet transport path.

In the thus configured image forming apparatus, a latent image of a yellow component color is first formed on the photosensitive drum 2*a* of the image forming unit 2. The latent image is developed as a yellow toner image by the developing section 2*b* having a yellow toner, and then transferred as a yellow toner image onto the intermediate transfer belt 7 by the first transfer roller 10*a*.

During a period when the yellow toner image is transferred to the intermediate transfer belt 7, a latent image of a magenta component color is formed in the image forming unit 3, and then a magenta toner image is developed by a magenta toner in the developing section 3*b*. The magenta toner image is transferred by the first transfer roller 10*b* of the image forming unit 3, to the intermediate transfer belt 7 in which the transfer of the yellow toner image by the image forming unit 2 has been ended, so that the magenta toner image is overlaid on the yellow toner image.

Thereafter, image forming processes are similarly conducted on cyan and black toner images, whereby the overlaying of the four color toner images on the intermediate transfer belt 7 is ended.

The color images formed on the intermediate transfer belt 7 are collectively transferred to the sheet P fed from the sheet supply cassette 13, by a nip force exerted between the driven roller 11 and the second transfer roller 12. The transferred toner images are thermally fixed to the sheet P by the fixing device 14 to form a full-color image on the sheet P, and the sheet is then discharged.

In the color image forming apparatus, as described above, the cleaning blade 19 is pushed so as to override the left and right hooks 20*a* and 120*a*, whereby the cleaning blade 19 is provisionally secured to the holding portions 20. The cleaning blade is then pressingly contacted by the photosensitive drum 2*a* to be completely secured to the image forming unit 2. Therefore, it is not required to secure the cleaning blade 19 by using screws, and the workability of the assembly process is improved.

The cleaning blade 19 is held by butting the base plate portion 19*b* against the holding portions 20 in the first, second, and third butting parts P1, P2, and P3.

As shown in FIG. 10, with respect to the force F1 which is produced in an approximately outward radial direction of the photosensitive drum 2*a* to 5*a* by the pressing contact between the photosensitive drum 2*a* to 5*a* and the cleaning blade 19, therefore, displacement of the cleaning blade is blocked by the first and second butting parts P1 and P2. With respect to the force F2 which, when the photosensitive drum 2*a* to 5*a* is rotated, acts on the cleaning blade 19 in a substantially tangential direction of the photosensitive drum 2*a* to 5*a*, displacement is blocked by the third butting part P3.

According to the configuration, the body portion 19*a* of the cleaning blade 19, and the photosensitive drum 2*a* contact each other at a uniform pressure over the whole butting face of the body portion 19*a*. Unlike the case where such a blade is secured by screws, therefore, displacement does not occur, so that the dimensional accuracy between the cleaning blade 19 and the photosensitive drum 2*a* to 5*a* can be properly ensured.

In the above, the embodiment in which the invention is applied to an image forming apparatus for forming a color image has been described. The invention can be applied also to an image forming apparatus for forming a monochrome image.

As described above, according to the invention, the cleaning blade is pressingly secured by the photosensitive member. Therefore, screws or the like are not necessary in fixation of the cleaning blade, and the dimensional accuracy between the cleaning blade and the photosensitive member can be properly ensured.

Moreover, the cleaning blade is attached to the holding portion by simply pushing the cleaning blade so as to override the hook. Therefore, it is possible to attain an effect that the workability of assembling of the cleaning blade is improved.

What is claimed is:

1. An image forming apparatus comprising:

a photosensitive member which is rotatably disposed, and on which an electrostatic latent image is developed to form a toner image;

a cleaning blade which comprises a body portion configured by an elastic plate member, and a base plate portion supporting said body portion, and which removes away a toner that remains on said photosensitive member after the toner image is transferred, by means of said body portion that pressingly contacts said photosensitive member;

a housing which holds said photosensitive member and said cleaning blade; and a recess which is disposed in said housing, and which accommodates at least part of said base plate, wherein said cleaning blade being pressingly secured to said recess by said photosensitive member, wherein said recess which is disposed in said housing has first and second projections which butt against said base plate portion.

2. An image forming apparatus according to claim 1, wherein said base plate portion has first and second end portions in a direction which is parallel to a rotation axis of said photosensitive member, said housing has first and second recesses which are opposed to said first and second end portions of said base plate portion, respectively, each of said first and second recesses has said first and second projections, said first end portion of said base plate portion butts against said first and second projections of said first recess, and said second end portion of said base plate portion butts against said first and second projections of said second recess.

3. An image forming apparatus according to claim 2, wherein part of said base plate portion is pressed against a bottom of said recess.

4. An image forming apparatus according to claim 2, wherein said recess has said bottom, a first wall which is positioned in front of said bottom in a rotation direction of said photosensitive member, and a second wall which is positioned in rear of said bottom in the rotation direction of said photosensitive member, said first projection is disposed on said first wall with being separated from said bottom by a predetermined distance, and said second projection is disposed on said second wall with being separated from said bottom by a distance which is larger than said predetermined distance.

5. An image forming apparatus according to claim 4, wherein a hook which prevents said cleaning blade from slipping off said housing is disposed on said housing.

6. An image forming apparatus according to claim 2, wherein longitudinal directions of said first and second projections are parallel to a rotation axis of said photosensitive member.

7. An image forming apparatus according to claim 6, wherein a hook which prevents said cleaning blade from slipping off said housing is disposed on said housing.

8. An image forming apparatus according to claim 2, wherein a hook which prevents said cleaning blade from slipping off said housing is disposed on said housing.

9. An image forming apparatus according to claim 8, wherein an engagement portion which is to be engaged with said hook is disposed in said base plate portion of said cleaning blade.

10. An image forming apparatus according to claim 1, wherein said recess has said bottom, a first wall which is positioned in front of said bottom in a rotation direction of said photosensitive member, and a second wall which is positioned in rear of said bottom in the rotation direction of said photosensitive member, said first projection is disposed on said first wall with being separated from said bottom by a predetermined distance, and said second projection is disposed on said second wall with being separated from said bottom by a distance which is larger than said predetermined distance.

11. An image forming apparatus according to claim 10, wherein a hook which prevents said cleaning blade from slipping off said housing is disposed on said housing.

12. An image forming apparatus according to claim 1, wherein longitudinal directions of said first and second projections are parallel to a rotation axis of said photosensitive member.

13. An image forming apparatus according to claim 12, wherein a hook which prevents said cleaning blade from slipping off said housing is disposed on said housing.

14. An image forming apparatus comprising:

a photosensitive member which is rotatably disposed, and on which an electrostatic latent image is developed to form a toner image;

a cleaning blade which comprises a body portion configured by an elastic elate member, and a base plate portion supporting said body portion, and which removes away a toner that remains on said photosensitive member after the toner image is transferred, by means of said body portion that pressingly contacts said photosensitive member;

a housing which holds said photosensitive member and said cleaning blade; and a recess which is disposed in said housing, and which accommodates at least part of said base plate, wherein said cleaning blade being pressingly secured to said recess by said photosensitive member, wherein part of said base plate portion is pressed against a bottom of said recess.

15. An image forming apparatus according to claim 14, wherein said cleaning blade is secured to said housing by said photosensitive member, said first and second projections, and said bottom of said recess.

16. An image forming apparatus according to claim 15, wherein a hook which prevents said cleaning blade from slipping off said housing is disposed on said housing.

17. An image forming apparatus comprising:

a photosensitive member which is rotatably disposed, and on which an electrostatic latent image is developed to form a toner image;

a cleaning blade which comprises a body portion configured by an elastic plate member, and a base plate portion supporting said body portion, and which removes away a toner that remains on said photosensitive member after the toner image is transferred, by means of said body portion that pressingly contacts said photosensitive member;

a housing which holds said photosensitive member and said cleaning blade; and a recess which is disposed in said housing, and which accommodates at least part of said base plate, wherein said cleaning blade being pressingly secured to said recess by said photosensitive member, wherein a hook which prevents said cleaning blade from slipping off said housing is disposed on said housing.

18. An image forming apparatus according to claim 17, wherein an engagement portion which is to be engaged with said hook is disposed in said base plate portion of said cleaning blade.

19. An image forming apparatus according to claim 17, wherein said hook is disposed in a vicinity of each of said first and second end portions of said base plate.

20. An image forming apparatus, comprising:

a photosensitive member that forms a toner image on a surface of the photosensitive member;

a cleaning blade that removes away, from the surface of the photosensitive member, a toner that remains on the surface of the photosensitive member after the toner image is transferred to a recording medium;

a base member that holds the cleaning blade, the base member having an end portion on each of both sides of the base member; and a housing that holds the photosensitive member, the housing having a pair of recesses inside the housing, the recess being configured to face toward the photosensitive member, the end portions of the base member to be inserted into the inside of the pair of the recesses, the cleaning blade to contact the photosensitive member, the end portions of the base member being pressingly fixed into the inside of the pair of the recesses by the photosensitive member, wherein the cleaning blade is secured to the recess by the photosensitive member.

21. The image forming apparatus according to claim 20, wherein the end portions of the base member butts into bottoms of the pair of the recesses.

22. The image forming apparatus according to claim 20, wherein the base member comprises an L-shape, one side of the L-shape holding the cleaning blade, and the housing has a hook that prevent the cleaning blade from slipping off the housing when another side of the L-shape catches on the hook.

23. The image forming apparatus according to claim 20, wherein an area between end portions of the base member comprises the L-shape.

24. The image forming apparatus according to claim 20, wherein the base member comprises an L-shape, one side of the L-shape holding the cleaning blade, and another side of the L-shape butting into an inside wall of the housing.

* * * * *